US006317043B1

(12) United States Patent
Berk

(10) Patent No.: US 6,317,043 B1
(45) Date of Patent: Nov. 13, 2001

(54) PERIMETER MONITORING SYSTEM

(75) Inventor: Thomas E. Berk, Scottsdale, AZ (US)

(73) Assignee: Beamerline, L.L.C., Scottsdale, AZ (US)

( * ) Notice: Subject to any disclaimer, the term of this patent is extended or adjusted under 35 U.S.C. 154(b) by 0 days.

(21) Appl. No.: 09/145,040

(22) Filed: Sep. 1, 1998

(51) Int. Cl.[7] ..... G08B 13/18

(52) U.S. Cl. ..... 340/555; 340/556; 340/557; 250/222.1; 250/214 B

(58) Field of Search ..... 340/555, 556, 340/557, 693.1; 250/347, 222.1, 214 B; 49/26–28

(56) References Cited

U.S. PATENT DOCUMENTS

| | | | | |
|---|---|---|---|---|
| 3,623,057 | | 11/1971 | Hedin et al. . | |
| 3,688,298 | | 8/1972 | Miller et al. . | |
| 3,898,639 | * | 8/1975 | Muncheryan | 340/555 |
| 4,004,805 | * | 1/1977 | Chen | 250/221.1 |
| 4,701,751 | | 10/1987 | Sackett . | |
| 4,910,498 | | 3/1990 | Feher . | |
| 4,949,075 | * | 8/1990 | Kiirti et al. | 340/555 |
| 5,508,511 | | 4/1996 | Zur et al. . | |
| 5,552,767 | * | 9/1996 | Toman | 340/540 |
| 5,559,509 | * | 9/1996 | Ogle | 340/557 |

* cited by examiner

*Primary Examiner*—Daniel J. Wu
*Assistant Examiner*—Anh La
(74) *Attorney, Agent, or Firm*—William R. Bachand; Squire, Sanders & Dempsey

(57) ABSTRACT

A perimeter monitoring system is arranged to detect passage across a perimeter of an area. The system primarily includes an emitter, a retroreflector, a detector and an alarm. The emitter provides a modulated visible laser beam. The retroreflector is arranged to direct the beam along a segment of the perimeter and return the beam along the segment. The detector includes a device that blocks reception of light outside an angle of less than 5 degrees. One or more local or remote alarms are activated in response to the signal. For example, a remote alarm is located on the inside of a residence window where it is activated by another visible laser beam. Alignment of the peripheral monitoring system is less costly and false alarms are less likely than with known systems.

27 Claims, 3 Drawing Sheets

PERIMETER MONITORING SYSTEM

FIELD OF THE INVENTION

This invention relates to systems for monitoring a perimeter of an area and for reliably sounding an alarm in response to ingress or egress across the perimeter.

BACKGROUND OF THE INVENTION

As an introduction to the problems solved by the present invention, consider for example the conventional perimeter alarm system based on laser beam interruption as used to monitor ingress onto a swimming pool apron. Such a system is difficult to initially install and requires considerable maintenance to control the occurrence of false alarms.

Many different physical effects of the installation can independently effect a false alarm. For example, when one infrared laser source is used with several mirrors to create a continuous path around the perimeter to be monitored, the initial alignment of the mirrors is costly. If any one mirror becomes misaligned, through sudden or gradual movement, the beam is interrupted as a false alarm. Correction of misalignment may require use of expensive infrared sensitive equipment. When the several mirrors are aligned sufficiently to remove the false alarm, one or more mirrors may not be positioned to reflect the beam from the center of the mirror. Consequently, the system's tolerance for future misalignment may be lower than expected.

The conventional detector for such a system may raise false alarms in response to light from sources other than from the laser source. Ambient sunlight may impinge upon the detector directly or as reflected by any surrounding surface or mirror. The angle of direct sunlight varies throughout the day and throughout the year to include a very wide range of angles. In addition, sunlight reflects from the surface of water in the swimming pool in an even wider range of angles varying randomly with wind conditions. The amount of background light on which a change is to be detected also varies making false detection more likely. An alignment of mirrors prescribed during installation or maintenance is unlikely to be sufficient for all of the above conditions.

The operator of such a system is exposed to risk of loss unnecessarily. As a result of false alarms, operators of such perimeter monitoring systems may be less likely to respond immediately when an alarm sounds. Failure to timely respond may result in a loss of life or property. When interrupted by a large number of false alarms, the operator may defeat the monitor or the alarm and not reactivate the monitor or the alarm due to operator irresponsibility or forgetfulness.

In view of the problems described above, the need remains in perimeter monitoring systems for higher reliability and lower installation and maintenance costs.

SUMMARY OF THE INVENTION

Accordingly, a perimeter monitoring system in one embodiment of the present invention includes a reflector, and a monitor. The reflector is positioned to receive a beam of light along a segment of a perimeter of an area to be monitored and to provide a returned beam along the segment. The monitor includes an emitter that provides the beam and a detector. The detector has an axis and provides a signal which includes indicia of a lapse in detecting the returned beam received substantially on the axis. In a variation, the detector includes a blocking device that blocks detection of light arriving substantially off the axis.

Initial set up and maintenance of such a system are greatly simplified by the use of visible light, use of a retroreflector, and the combination of visible light and retroreflector. Placement of mirrors in cooperation with the retroreflector is also simplified. The result is a much wider tolerance for misalignment of such mirrors and of the retroreflector, and consequently, a dramatic decrease in installation and maintenance costs.

In another embodiment, a transceiver includes a partition that separates a laser emitter from a detector. In a variation, the partition includes a printed circuit substrate for mounting the emitter and detector. In another variation the detector includes a blocking device that blocks detection of light arriving substantially off the axis.

The use of a blocking device as described above decreases the possibility of false alarm. By blocking the reception of light except in a very small range of angles (e.g., 0.5 to 5 degrees), ambient light, whether sunlight or artificial, and whether direct or scattered, has little or no effect on the detector.

BRIEF DESCRIPTION OF THE DRAWING

The preferred exemplary embodiment of the present invention will be described in conjunction with the drawing, wherein.

DETAILED DESCRIPTION OF THE PREFERRED EMBODIMENTS

A system of the present invention includes any system for reliably monitoring passage across a segment of the perimeter of an area. Depending on the area to be monitored, some segments of the area may be determined to be more likely to be used for ingress or egress as opposed to other segments. For example, a reliable system may be installed to monitor only one segment, such as a doorway. The more problematic situation, however, arises in installations that monitor several segments, possibly forming a polygonal series of segments to monitor ingress or egress along any direction. In such an installation, a system of the present invention may use a single enclosure for system electronic components to reduce manufacturing and installation expense. In other installations, multiple enclosures may monitor a respective one or series of segments.

Figure 1:
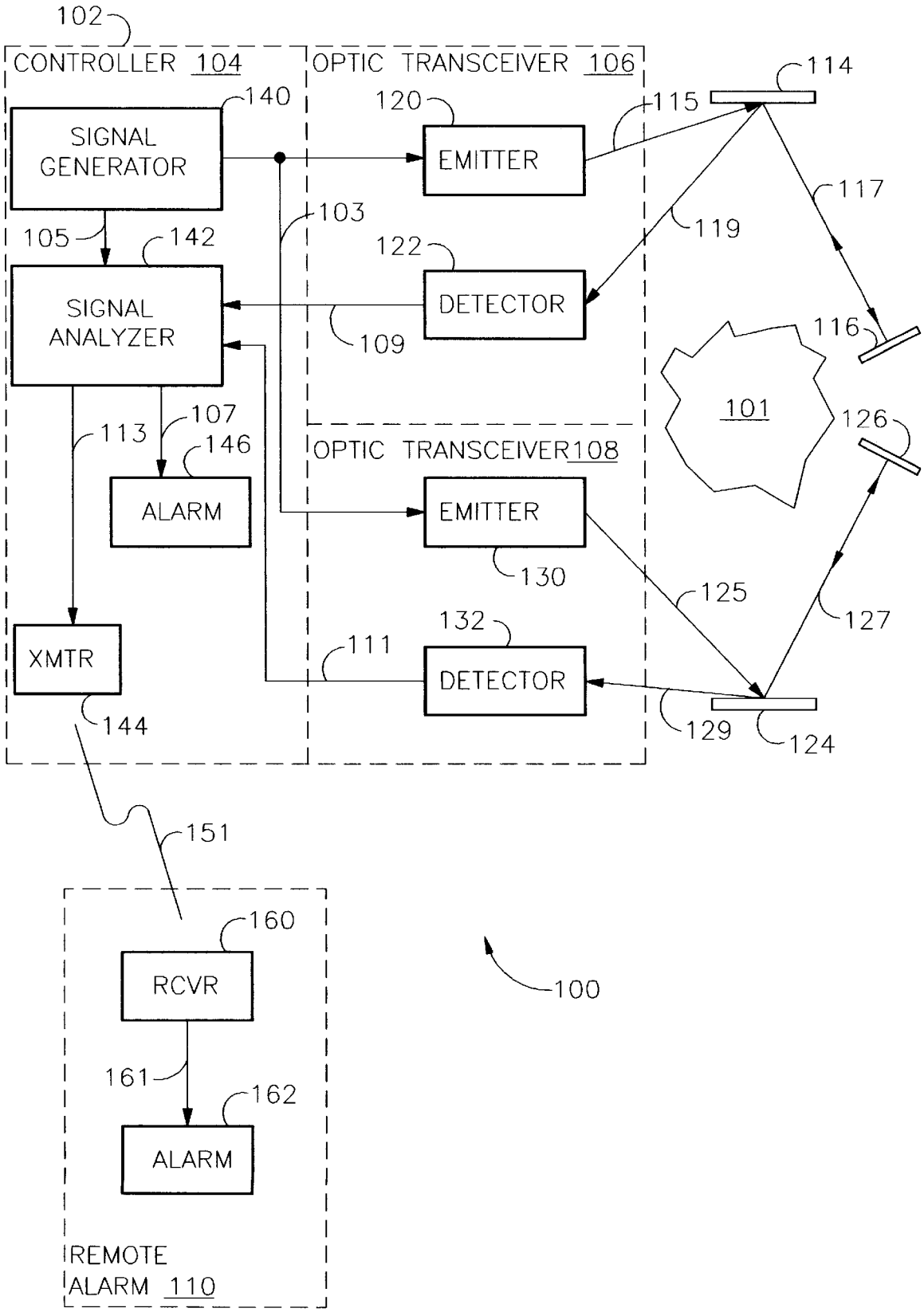
FIG. 1 is a functional block diagram of a system of the present invention.

For example, system 100 of FIG. 1 includes monitor 102 in a single enclosure that monitors a series of segments fully surrounding area 101. Area 101 may be any indoor and/or outdoor area which may be monitored for any purpose including for example personal safety, property protection, data security, or equipment configuration control. In operation, for example, an ingress into area 101 by passage across one (or more) segment(s) is detected as an interruption of a respective laser beam. Such interruption gives raise to an alert condition. The possibility of false alarms as described in the background section is dramatically reduced.

In FIG. 1, the angles of incidence and reflection for mirrors 114 and 124 and the length of segments 115, 117, 119, 125, 127, and 129 are not to scale and are shown schematically for ease of description of operation. The physical distance between an emitter and a detector is usually quite small in comparison to the distance between an optic transceiver and a reflector. Therefore, for example, segments 115 and 119 (or 125 and 129) are essentially physically aligned, though in FIG. 1 they appear askew. Laser light is used in a preferred variation and is collimated through a lens, as discussed below. The lens creates a spot of light that increases in diameter with distance from the emitter. By the time the spot reaches the detector, at least a portion of the spot is visible to the detector at a short distance away from the center of the originally transmitted beam.

A monitor according to aspects of the present invention includes any device that transmits and receives one or more modulated laser beams, each beam being detected substantially in line with the transmitted beam. For example, monitor 102 includes in one enclosure controller 104, and optic transceivers 106 and 108. Controller 104 includes signal generator 140, signal analyzer 142, transmitter 144 and alarm 146. Optic transceivers 106 (and 108) respectively include an emitter 120 (130), and detector 122 (132). The structure and operation of optic transceivers 106 and 108 are preferably identical except as to physical positioning. Monitor 102 is constructed using conventional mechanical and electronic techniques except as discussed below.

In operation, emitter 120 emits a beam of visible laser light that follows segment 115 toward mirror 114. The beam proceeds on segment 117 (by Snell's Law) toward retroreflector 116 and is then reflected back along the same segment. A retroreflector conventionally includes an array of prisms for reflecting a beam back along the same segment, regardless of the angle the beam makes with the retroreflector. Upon second reflection by mirror 114, the beam follows segment 119 to detector 122. Detector 122 is preferably mounted close to emitter 120 (e.g., less than 2 cm) so that at the focal length of the segments traversed, detector 122 receives a portion of the beam close to the center of the beam. For example, the spot size provided by emitter 120 may be in the range from 0.318 cm to 0.636 cm; and, the spot size received after a focal path of about 20 meters may be in the range from 7.6 cm to 10 cm. Mirrors and retroreflector(s) of any shape may be used, although first surface mirrors are preferred to avoid distortion of the spot size and shape. For example, for the spot sizes described above, mirrors and retroreflectors having facial dimensions of about 5.0 cm to 10 cm square may be used. For monitoring the perimeter of an outdoor water hazard, vertical misorientation has been found to be minimal in comparison with horizontal misorientation, due in part to wind effects. In such an installation, reflectors (e.g., mirrors, reflective surfaces, and/or retroreflectors) about 5.0 cm high and about 16 cm wide (horizontal) are preferred. Use of a larger horizontal dimension simplifies installation by providing more area for reflection when the reflector is placed at an angle to the beam. Emitter 130, mirror 124, and detector 132 operate in an analogous fashion with retroreflector 126. The length of segments 115, 117, 125, and 127 may all be different from each other; however, the length of segments 115 and 119 (and by analogy 125 and 129) are substantially the same.

In a variation, retroreflector 116 is oriented to provide return beams on both segments 117 and 127 and retroreflector 126 is omitted. In another variation, retroreflectors 116 and 126 are not co-located, for example, where monitoring only a few segments of a perimeter is sufficient.

Although visible laser light is preferred, variations according to the present invention include any light beam.

Initial installation is simplified by use of multiple beams, visible laser light, and retroreflectors. For installation on level ground, as for an outdoor swimming pool within area 101, each beam (from emitter 120 and 130) is located parallel to and above the ground by a height in a range from 20 cm to 60 cm. The minimum height is preferred to protect pets and toddlers; whereas, the maximum height is preferred to protect children and adults who might inadvertently step over a low beam without interrupting it. In a variation, multiple beams are arranged on one or more segments to improve thoroughness of monitoring.

A method of installing system 100 according to aspects of the present invention includes the steps:

(a) placing and activating monitor 102, (b) placing reflectors 114, 116, 124, 126 at an acceptable elevation so that the beam will impinge on part of each reflector with a margin for vibration or shifting with time, (c) for each optic transceiver, activating the optic transceiver, directing the emitted beam toward a reflector, and (d) for each reflector (e.g., mirror and/or retroreflector) directing the reflected beam toward another reflector or back toward the appropriate detector.

Steps (a) and (b) may be performed in any sequence. In step (b), a suitable retroreflector for each beam may be desirable. In step (c), orienting optic transceiver 106 (or 108) accomplishes, in one motion, orienting both the emitter and detector, when these elements are in fixed relation to each other. Steps (c) and (d) do not require special equipment when visible low power laser light is emitted by the optic transceivers. Such light is easily scattered by briefly interrupting the beam with any object, for example, a small piece of paper or clothing.

An optic transceiver according to aspects of the present invention may be constructed with any physical arrangement of emitter and detector to provide isolation between the emitter and detector and to provide detection of returned energy. Electrical and optical cross-talk may be reduced in any conventional manner; however, such cross-talk may be advantageously reduced according to aspects of the present invention discussed below. For example, a partition may be introduced between the emitter and detector. Detection may be accomplished in any manner and may include one or more optical structures (e.g., a lens, filter, and/or blocking device) as well as one or more electronic structures (e.g., a filter, isolator, and/or ground plane).

Figure 2:
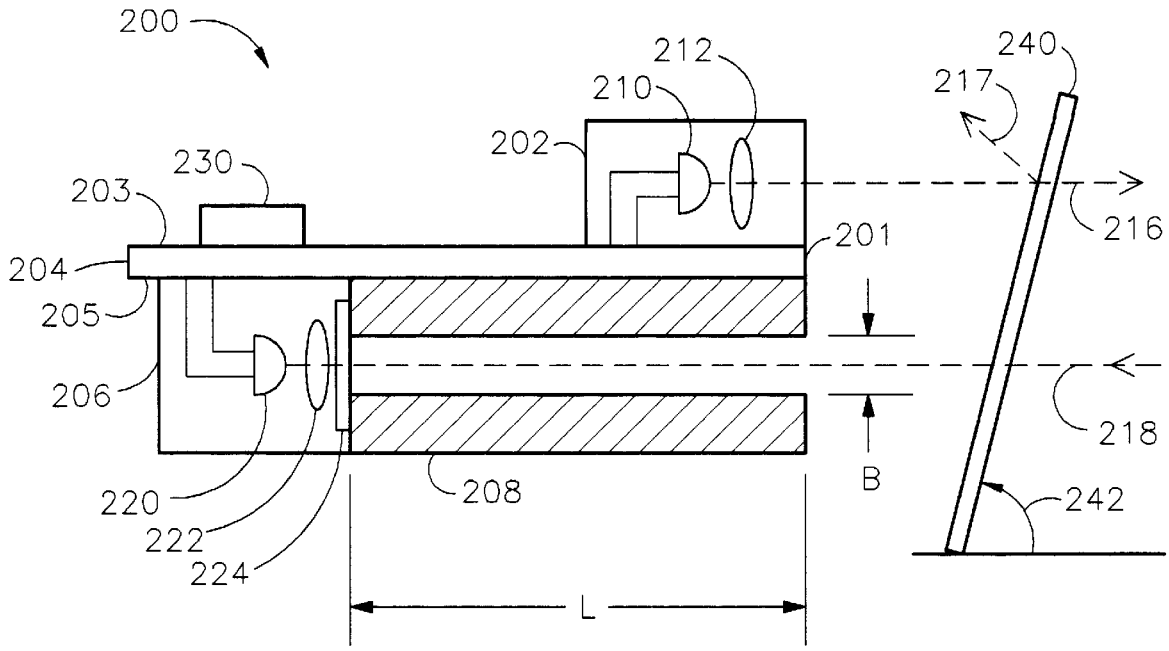
FIG. 2 is a cross section view of an optic transceiver of FIG. 1.

For example, optic transceiver 200, shown in cross section in FIG. 2, may be used for optic transceivers 106 and 108 in FIG. 1. Optic transceiver 200 primarily includes substrate 204, integrated circuit 230, emitter module 202, detector module 206, and tube 208. Integrated circuit 230 is a conventional integrated circuit that generally represents all suitable circuitry for functional support for emitter module 202 and detector module 206. Substrate 204 may be an opaque partition or additionally include printed circuitry (e.g. of conventional copper and epoxy-glass constitution) that includes suitable signal layout features that electrically isolate signals for emitter and detector modules. Emitter module 202, mounted on side 203 of substrate 204 and at the forward most edge 201, includes conventional laser diode 210 and lens 212, all sealed for mechanical stability in a clear plastic. In a variation, lens 212 is omitted and focusing is accomplished by the sealing material. Emitter module 202 produces a visible beam of laser light on axis 216. Detector module 206, mounted on side 205 of substrate 204 (opposite side 203), includes conventional photosensitive semiconductor 220 (e.g., a photodiode, semiconductor switch, transistor, or darlington array), lens 222, and filter 224. In a variation, lens 222 and filter 224 are omitted and focusing and filtering are accomplished by the sealing material.

Cross-talk between emitter module 202 and detector module 206 may be reduced in several ways. As shown, substrate 204 forms an optical barrier between emitter module 202 and detector module 206. When both modules are mounted on the same side of substrate 204, an opaque barrier is placed between them. Optic transceiver 200 is located within an enclosure, formed in part by transparent bezel 240. Optical isolation is enhanced by mounting emitter module 202 as close as possible to bezel 240. Further optical isolation is accomplished, as shown, by locating bezel 240 on an angle 242 to a reference plane parallel to beam 216. When angle 242 is less than 90 degrees, preferably about 85 degrees, reflected beam 217 of beam 216 is directed away from the bore of tube 208. The inner surface of bezel 240 may be coated with a conventional impedance matching (anti-reflecting) substance to further reduce cross-talk.

A blocking device, according to aspects of the present invention, includes any apparatus that passes energy within a small angle from a central axis. For example, a blocking device used in optical transceiver 200 primarily includes tube 208. Tube 208 has length L and bore B selected to permit passage of light to detector module 206 in a narrow range of angles. Semiconductor 220 receives light through a surface of module 206, for example, the planar surface of filter 224. Axis 218 is perpendicular to such a surface. Generally, the maximum angle measured to axis 218 for light reaching the interface between filter 224 and tube 208 is arctan(B/2L). Suitable allowances should be made for the position of lens 222 and any reflections within the bore. The maximum angle (without accounting for reflections) is within a range from 5 degrees to 0.5 degree, preferably about 1.8 degrees. In other words, the ratio of B over 2L is in the range from 0.02 to 0.25, preferably about 0.03. In one variation where B is no more than 0.318 cm and L is no less than 5.0 cm, the maximum angle is about 1.8 degrees.

Figure 4:
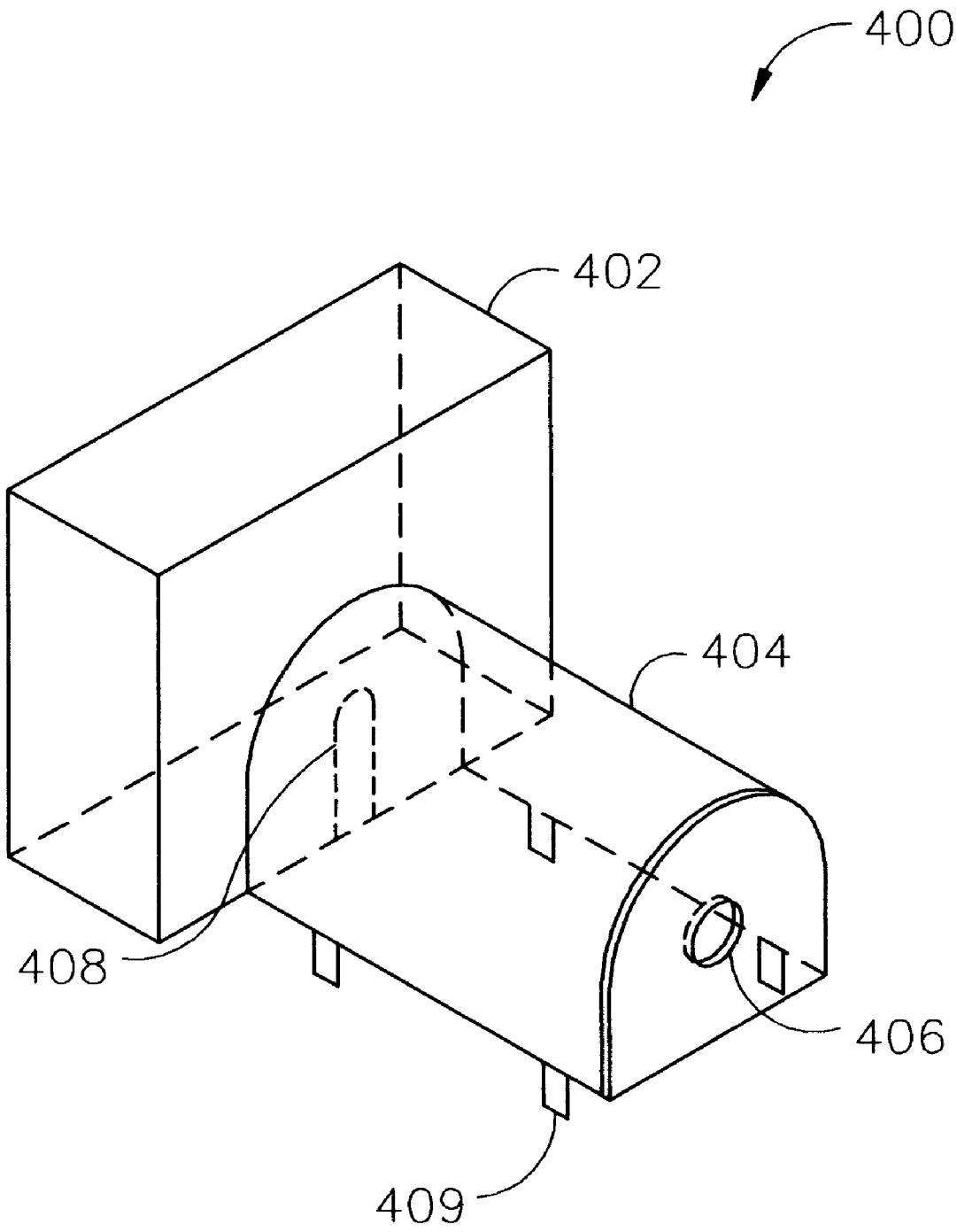
FIG. 4 is a perspective view of a blocking device according to aspects of the present invention.

In a variation, a blocking device according to aspects of the present invention includes a passage and aperture placed prior to, between, or after one or more conventional lenses and/or filters. For example, detector module 206 may cooperate with housing 400, of FIG. 4. In such a variation, a blocking device includes lens 222, filter 224, and housing 400. Housing 400 is constructed of opaque plastic and includes two compartments. Compartment 402 surrounds detector module 206 except for slot 408 which admits light into detector module 206. Compartment 404 provides an elongated empty space somewhat analogous to the length L of tube 208, discussed above. Aperture 406 admits light into compartment 404. Housing 400 may be mounted against substrate 204 using four feet 409 and an optic gasket or sealing material to assure that light that is received by the detector entered the compartment through aperture 406. In one variation, aperture 406 has a diameter of about 0.3 cm, compartment 404 has a length of about 4.4 cm, and slot 408 has a width of about 0.3 cm.

In operation, the detector (e.g., 220 of detector module 206) is not responsive to light arriving at aperture 406 that is substantially off an axis defined as passing through aperture 406 to the detector. Off axis light is blocked or scattered. Filter 224, whether positioned as shown in FIG. 2, placed before or after slot 408, before or after aperture 406, or within compartment 404, causes the detector to be responsive primarily to only a filtered component of the light arriving at aperture 406.

In yet another variation, an alternate detector may include a narrow angle optical receiver. A narrow angle optical receiver may include a detector (as discussed above) and an integral blocking device. For example, an integrated circuit detector having a semiconductor region of light sensitivity may be formed behind an aperture or within a well formed in a layer of opaque material. In this example, conventional semiconductor fabrication techniques may be used to form the detector, aperture and/or well.

Accurate detection of received beam 218 is enhanced by blocking light that is not within a narrow pass band of wavelengths common to the wavelength of beam 216. For example, when laser diode 210 emits red light having a wavelength of about 670 nanometers, a filtering bezel that optimally passes red light having a wavelength of about 670 nanometers is preferred. When a clear bezel 240 is used, a colored filter at the entrance end of tube 208 may be used.

Each laser beam used along a segment about an area to be monitored may be continuous or pulsed and in either case may be further modulated. Any conventional modulation may be used to reduce power consumption, reduce average power level, or improve the reliability of detection. Modulation may include a combination of conventional techniques including: pulsing the beam on for a short period of time regularly or in a pseudo random manner; providing a burst of such pulses; amplitude modulating the beam to convey one or more periods of a pulse, sinusoid, or complex waveform; frequency modulation of the beam; or frequency or phase shift modulation of a signal conveyed by amplitude modulation.

For example, in system 100, emitters 120 and 130 respond to signal generator 140 via signals on line 103 to pulse modulate respective beams at a constant rate and constant duty cycle. Beams are off during a portion of each duty cycle. Each detector 122 and 132 provides a detector output signal DO respectively on lines 109 and 111 to signal analyzer 142.

Figure 3:
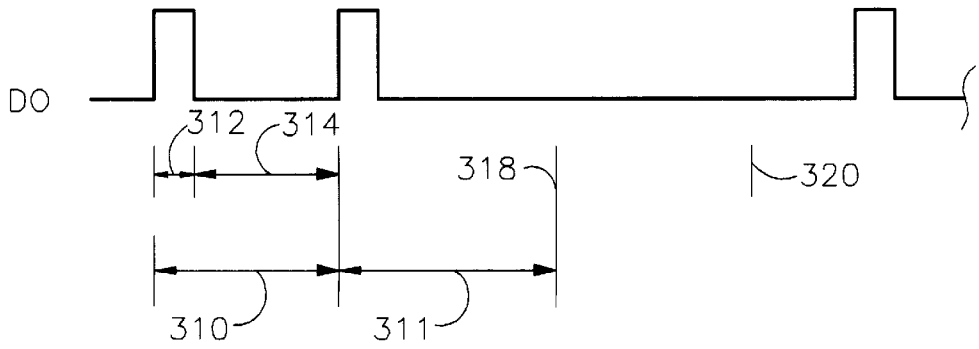
FIG. 3 is a timing diagram of a detector output signal according to aspects of the present invention.

Signal DO, as in FIG. 3, includes regular period 310 which in turn includes duration 312 when received light exceeds a minimum intensity (e.g. a constant threshold), and duration 314 when received light does not exceed the minimum. Positive logic is used here for convenience of description and conventional negative logic may be used in variations. For monitoring a perimeter near an outdoor swimming pool, period 310 is preferred to be about 6 msec. Regardless of the period 310, the duty cycle (312 divided by 310) may be about 50 percent. In a variation, duty cycle is adjusted to improve detection and may be in the range from 50 to 90 percent, preferably about 85 percent. In a variation, the minimum value is adjusted on the basis of conventional signal recovery techniques including time of day/month/year, the external ambient light level, automatic gain control, and analog and/or digital filtering. The minimum should be selected according to the expected light noise characteristics expected to occur in the area being monitored. For example, a minimum of about 3 msec is satisfactory to distinguish a returned pulse from a glint of sunlight reflected from an outdoor swimming pool.

A signal analyzer according to aspects of the present invention includes any conventional circuit that raises an alert condition in response to the absence of an expected feature of an input signal. Such an absence is generally assumed to coincide with interruption of one or more beams.

For example, for signal DO of FIG. 3, an alert condition may be raised by signal analyzer 142 at any time after time 318 when the duration 311 exceeds the duration 310. In such a case the minimum time may be just greater than the duration 310, the pulse repetition period of one pulse. In an alternate variation, several periods may pass without receiving a pulse. For example, an alert condition may be raised following time 320 because two pulse periods of duration 310 have passed without receiving a pulse. In variations, the minimum duration is constant and set to any duration less than 10 periods, preferably 7 periods.

In one variation, signal analyzer 142 compares a signal on line 105 (provided by signal generator 140) to the signals on lines 109 and 111 (provided by detectors 122 and 132). In a second variation, line 105 is omitted and signal analyzer 142 compares signals 109 and 111. In each of these variations, a difference between compared signals may be used to trigger a timer (or counter) to detect lapse of a period of time having an absence of an expected pulse.

In another variation, when line 105 is omitted, signal analyzer 142 includes a separate independent logic circuit for each optic transceiver (up to a maximum, such as 8). Each logic circuit includes a timer that raises an alert condition if not retriggered within a maximum period of time (e.g., 7 periods 310).

The period of time discussed above as a number of periods 310 during which an expected pulse is not received may be set to a predetermined time irrespective of the period 310. For example, a period of about 10 msec to about 50 msec is satisfactory. Less than 10 msec may be undesirable as it may permit heavy rain to activate the alarm. About 50 msec is sufficient to avoid false alarms that could be raised for blowing debris and birds flying through the beam. It is preferred to set the period, lapse of which raises an alert condition, in the range from 35 msec to 45 msec, preferably 40 msec for protecting the perimeter of an outdoor water safety hazard from entry by children.

When an alert condition is raised, according to aspects of the present invention, any number of local and/or remote alarms may be activated. A system of the present invention includes any system that selectively activates one or more alarms via one or more communication links.

For example, signal analyzer 142 provides a signal on line 107 to local alarm 146 and a signal on line 113 to transmitter 144. The signal on line 107 activates alarm 146 which may be any conventional audio and/or visual alarm. System 100 also includes remote alarm 110. Remote alarm 110 includes receiver 160 and alarm 162. Transmitter 144 responds to the signal on line 113 by transmitting a signal via link 151 to receiver 160. On detection of a suitable signal via link 151, receiver 160 activates alarm 162 by a signal on line 161. Alarm 162 includes an audible and/or visual alarm, or any conventional alarm. In a variation, alarm 162 includes downlink capability (not shown) to place a telephone call to a predetermined party for logging, awareness, or emergency response. In another variation remote alarm 110 is of the type described as a conventional pager that alerts the user by vibrating.

In a preferred variation, transmitter 144 emits a beam of modulated visible laser light that signals receiver 160 through the window of a building such as a residence. Transmitter 144 and receiver 160 cooperate using any modulation described above with reference to optic transceiver 106, or any conventional modulation. Remote alarm 110 preferably includes a fastener for attaching remote alarm 110 to the window. When used on the window of a residence, alarm 162 may be more effective (audible, visible, etc.) to residents than alarm 146. Alarm 162 also provides redundancy to alarm 146.

A perimeter monitoring system of the present invention may be advantageously used near an outdoor pool or stream of water. False alarms are dramatically fewer than with conventional systems. For example, systems based on devices that float in the water are more subject to wind variation than systems of the present invention. Systems based on infrared based movement detection in a wide-area are subject to wind, sunlight reflections from the water, and from movement of debris, pets, furniture, toys, or landscaping which may be within the wide-area being monitored. Systems of the present invention accommodate such activity and do not raise a false alarm due in part to the detection and signal timing described above. Systems of the present invention also accommodate pools having automatic cleaning systems without raising a false alarm. As an additional cost saving advantage, systems of the present invention having two emitters are easier to install and maintain than systems having one emitter because one beam typically travels a longer distance than each of two beams and typically undergoes more reflections to return to the monitor.

The foregoing description discusses preferred embodiments of the present invention, which may be changed or modified without departing from the scope of the present invention. While for the sake of clarity and ease of description, several specific embodiments of the invention have been described; the scope of the invention is intended to be measured by the claims as set forth below. The description is not intended to be exhaustive or to limit the invention to the form disclosed. Other embodiments of the invention will be apparent in light of the disclosure to one of ordinary skill in the art to which the invention applies.

What is claimed is:

1. A perimeter monitoring system comprising:

a. a reflector positioned to receive a beam of light along a segment of a perimeter of an area to be monitored and to provide a returned beam along the segment, the returned beam comprising a pulse modulation having a pulse repetition period;

b. a monitor comprising:

(1) an emitter that provides the beam;

(2) a detector having an axis, the detector providing a signal comprising indicia of a lapse in detecting the returned beam, the detector comprising a blocking device that blocks detection of light not received through a passage having an aperture, wherein the aperture has a diameter and the passage has a length, a ratio of the diameter to the length being less than 0.1;

(3) an opaque partition between the emitter and the detector;

(4) an enclosure that encloses the emitter and the detector, the enclosure comprising a surface that passes the beam and the returned beam through the surface, the surface oriented to direct a reflected portion of the beam away from the axis; and (5) a timer that provides an alert signal on lapse of a time greater than the period, the timer being retriggered in response to the signal;

c. transmitter that transmits light in response to the alert signal; and d. a remote alarm comprising a receiver and an alarm, wherein the receiver activates the alarm in response to receiving the transmitted light.

2. The system of claim 1 wherein:

a. the partition comprises a printed circuit substrate, the emitter and the detector being electrically connected to the printed circuit substrate; and b. the lapse of time has a duration in the range from 35 to 45 milliseconds.

3. A perimeter monitoring system comprising:

a. a reflector positioned to receive a beam of light along a segment of a perimeter of an area to be monitored and to provide a returned beam along the segment; and b. a monitor comprising:

(1) an emitter that provides the beam;

(2) a detector having an axis, the detector providing a signal comprising indicia of a lapse in detecting the returned beam received along the axis and the detector comprising a blocking device that blocks detection of light arriving substantially off the axis, wherein the blocking device comprises an aperture having a diameter and a passage having a length, a ratio of the diameter and the length in a ratio less than 0.1;

(3) an opaque partition between the emitter and the detector; and (4) an enclosure that encloses the emitter and the detector, the enclosure comprising a surface that passes the beam and the returned beam through the surface, the surface oriented to direct a reflected portion of the beam away from the axis.

4. The system of claim 3 wherein the monitor further comprises a timer that provides an alert signal on lapse of a time, the timer being retriggered in response to the signal, the lapse having a duration in the range from 35 to 45 milliseconds.

5. The system of claim 4 further comprising:

a. a transmitter that transmits light in response to the alert signal; and b. a remote alarm comprising a receiver and an alarm, wherein the receiver activates the alarm in response to receiving the transmitted light.

6. A perimeter monitoring system comprising:

a. a reflector positioned to receive a beam of light along a segment of a perimeter of an area to be monitored and to provide a returned beam along the segment; and b. a monitor comprising:

(1) an emitter that provides the beam;

(2) a detector having an axis, the detector providing a signal comprising indicia of a lapse in detecting the returned beam, the detector comprising a blocking device that blocks detection of light arriving substantially off the axis, wherein the blocking device comprises an aperture having a diameter and a passage having a length, a ratio of the diameter and the length in a ratio less than 0.1; and (3) an enclosure that encloses the emitter and the detector, the enclosure comprising a surface that passes the beam and the returned beam through the surface, the surface oriented to direct a reflected portion of the beam away from the axis.

7. The system of claim 6 wherein the blocking device comprises a lens.

8. The system of claim 6 wherein the blocking device blocks light arriving at greater than 5 degrees from the axis.

9. The system of claim 6 further comprising an opaque partition between the emitter and the detector.

10. The system of claim 9 wherein the partition comprises a printed circuit substrate, the emitter being mounted on a first side of the substrate and the detector being mounted on a second side of the substrate.

11. The system of claim 6 wherein:

a. the system further comprises a second reflector positioned to receive a second beam of light along a second segment of the perimeter of the area to be monitored and to provide a second returned beam along the second segment; and b. the monitor further comprises:

(1) a second emitter that provides the second beam; and (2) a second detector having a second axis, the second detector providing a second signal comprising second indicia of a second lapse in detecting the second returned beam, the second detector comprising a second blocking device that blocks detection of light arriving substantially off the second axis.

12. The system of claim 11 further comprising a signal analyzer that provides an alert signal in response to the indicia of the signal provided by the detector, and provides the alert signal in response to the second indicia of the second signal provided by the second detector.

13. The system of claim 12 wherein the signal analyzer comprises a comparator that provides the alert signal in response to comparing the signal and the second signal provided by the second detector.

14. The system of claim 6 wherein the beam comprises a modulation.

15. The system of claim 6 wherein:

a. the emitter provides the beam in response to a modulation signal;

b. the system further comprises a second reflector positioned to receive a second beam of light along a second segment of the perimeter of the area to be monitored and to provide a second returned beam along the second segment; and c. the monitor further comprises:

(1) a second emitter that provides the second beam, the second beam comprising the modulation, the second emitter providing the second beam in response to the modulation signal;

(2) a second detector having a second axis, the second detector providing a second signal comprising second indicia of a second lapse in detecting the second returned beam, the second detector comprising a second blocking device that blocks detection of light arriving substantially off the second axis;

(3) a signal generator that provides the modulation signal; and (4) a signal analyzer that provides an alert signal in response to comparing the modulation signal and the signal provided by the detector, and provides the alert signal in response to comparing the second signal provided by the second detector and the modulation signal.

16. The system of claim 6 wherein:

a. the beam comprises a modulation having a repetition period; and b. the monitor further comprises a timer that provides an alert signal on lapse of a time greater than the period, the timer being retriggered in response to the signal.

17. The system of claim 16 wherein the time has a duration in the range from 35 to 45 milliseconds.

18. The system of claim 16 wherein the time has a duration of an integer multiple of the period.

19. The system of claim 6 further comprising:

a. a transmitter that transmits an alert signal in response to the signal provided by the detector; and b. a remote alarm comprising a receiver and an alarm, wherein the receiver activates the alarm in response to receiving the alert signal.

20. The system of claim 19 wherein the alert signal comprises laser light.

21. The system of claim 6 wherein the beam comprises visible light.

22. The system of claim 6 wherein the beam comprises laser light.

23. The system of claim 6 wherein the reflector comprises a retroreflector.

24. A transceiver comprising:

a. an emitter that provides a beam of laser light;

b. a detector having an axis, the detector responsive to light received only substantially on the axis, wherein a reflected portion of the beam is directed away from the axis; and c. a partition located between the emitter and the detector; and d. wherein the detector comprises a blocking device, wherein the blocking device comprises a passage and an aperture, the detector responsive to light received through the aperture and through the passage, wherein the aperture has a diameter, and wherein the passage has a length, a ratio of the diameter to the length being less than 0.1.

25. The transceiver of claim 24 wherein the partition comprises a printed circuit substrate, the emitter and the detector being electrically connected to the printed circuit substrate.

26. The transceiver of claim 24 wherein the blocking device further comprises a filter.

27. A perimeter monitoring system comprising:

a. a retroreflector positioned to receive a beam of visible light along a segment of a perimeter of an area to be monitored and to provide a returned beam along the segment, the returned beam comprising a pulse modulation having a pulse repetition period;

b. a monitor comprising:

(1) an emitter that provides the beam;

(2) a detector having an axis, the detector providing a signal comprising indicia of a lapse in detecting the returned beam, the detector comprising a blocking device that blocks detection of light, wherein the blocking device comprises a passage and an aperture, the detector responsive to light received through the aperture and through the passage, wherein the aperture has a diameter, and wherein the passage has a length, a ratio of the diameter to the length being less than 0.1;

(3) an opaque partition between the emitter and the detector;

(4) an enclosure that encloses the emitter and the detector, the enclosure comprising a surface that passes the beam and the returned beam through the surface, the surface oriented to direct a reflected portion of the beam away from the axis; and (5) a timer that provides an alert signal on lapse of a time greater than the period, the timer being retriggered in response to the signal;

c. transmitter that transmits visible light in response to the alert signal; and d. a remote alarm comprising a receiver and an alarm, wherein the receiver activates the alarm in response to receiving the transmitted visible light.

* * * * *